US009298144B2

(12) United States Patent
Bayerle et al.

(10) Patent No.: US 9,298,144 B2
(45) Date of Patent: Mar. 29, 2016

(54) BACKUP BELT ASSEMBLY FOR A FUSING SYSTEM

(71) Applicant: Lexmark International, Inc., Lexington, KY (US)

(72) Inventors: Peter Alden Bayerle, Lexington, KY (US); Jeffery James Buchanan, Lexington, KY (US); Michael Clark Campbell, Lexington, KY (US); Benjamin Karnik Johnson, Lexington, KY (US); Charles Scott McDavid, Frankfort, KY (US); Fangsheng Wu, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/140,662

(22) Filed: Dec. 26, 2013

(65) Prior Publication Data

US 2015/0185672 A1 Jul. 2, 2015

(51) Int. Cl.
*G03G 15/20* (2006.01)

(52) U.S. Cl.
CPC ..... *G03G 15/206* (2013.01); *G03G 15/2089* (2013.01); *G03G 2215/2009* (2013.01)

(58) Field of Classification Search
CPC ..... G03G 15/206; G03G 15/2064; G03G 15/2089; G03G 2215/2009; G03G 2215/2012
USPC ..... 399/329; 219/216
See application file for complete search history.

(56) References Cited

U.S. PATENT DOCUMENTS

| | | | | |
|---|---|---|---|---|
| 4,050,803 | A | 9/1977 | McCarroll | |
| 4,145,181 | A | 3/1979 | Edwards et al. | |
| 4,392,739 | A | 7/1983 | Brown et al. | |
| 4,578,427 | A | 3/1986 | Saito et al. | |
| 5,113,223 | A | 5/1992 | Theodoulou et al. | |
| 5,212,528 | A | 5/1993 | Matsuda | |
| 5,614,999 | A * | 3/1997 | Kanesawa et al. | 399/329 |
| 5,708,920 | A | 1/1998 | Ohnishi et al. | |
| 6,157,806 | A | 12/2000 | Elbert et al. | |
| 6,253,046 | B1 | 6/2001 | Horrall et al. | |
| 7,349,660 | B2 | 3/2008 | Domoto et al. | |
| 7,398,028 | B2 | 7/2008 | Nakagaki | |
| 7,565,091 | B2 | 7/2009 | Jao et al. | |
| 7,925,198 | B2 | 4/2011 | Urano | |

(Continued)

FOREIGN PATENT DOCUMENTS

| | | | |
|---|---|---|---|
| JP | 01121883 | A | 5/1989 |
| JP | 01266557 | A | 10/1989 |

(Continued)

*Primary Examiner* — Robert Beatty

(57) ABSTRACT

A backup belt assembly includes an endless belt, at least a pair of nip forming rollers contacting an inner surface of the endless belt and positioned relative to the fuser roller to provide pressure to a section of an outer surface of the fuser roller adjacent the endless belt so as to form an elongated fusing nip along the section. A first roller of the pair of nip forming rollers engages the fuser roller via the endless belt at an entrance of the elongated fusing nip, while a second roller of the pair of nip forming rollers engages the fuser roller via the endless belt at an exit of the elongated fusing nip. The first roller provides a lower amount of pressure to the fuser roller relative to the pressure provided by the second roller. A supporting roller may be disposed within the endless belt near the entrance of the elongated fusing nip for providing acceptable media entry geometry.

21 Claims, 6 Drawing Sheets

(56) References Cited

U.S. PATENT DOCUMENTS

| | | | | |
|---|---|---|---|---|
| 7,995,957 | B2 | 8/2011 | Sone et al. | |
| 8,180,269 | B2 | 5/2012 | Beach et al. | |
| 8,200,137 | B2 | 6/2012 | Foster et al. | |
| 8,238,770 | B2 | 8/2012 | Shimizu | |
| 2002/0118982 | A1 | 8/2002 | Fuma | |
| 2004/0120741 | A1 | 6/2004 | Kim et al. | |
| 2005/0089343 | A1 | 4/2005 | Mathers | |
| 2005/0163542 | A1* | 7/2005 | Gilmore et al. | 399/329 |
| 2005/0185978 | A1 | 8/2005 | Kemmochi | |
| 2006/0039723 | A1* | 2/2006 | Kitazawa et al. | 399/328 |
| 2006/0291919 | A1 | 12/2006 | Domoto et al. | |
| 2007/0019063 | A1 | 1/2007 | Yasuda et al. | |
| 2008/0280035 | A1 | 11/2008 | Jao et al. | |
| 2008/0304879 | A1 | 12/2008 | Tamura | |
| 2010/0054828 | A1 | 3/2010 | Urano | |
| 2010/0151068 | A1 | 6/2010 | Hurst et al. | |
| 2010/0329705 | A1 | 12/2010 | Cao et al. | |
| 2011/0159176 | A1 | 6/2011 | Chen et al. | |
| 2013/0058673 | A1 | 3/2013 | Kikkawa | |
| 2013/0202334 | A1* | 8/2013 | Takahashi et al. | 399/329 |
| 2013/0251392 | A1 | 9/2013 | Ueda et al. | |
| 2014/0369725 | A1 | 12/2014 | Bayerle et al. | |
| 2014/0369729 | A1 | 12/2014 | Bayerle et al. | |
| 2014/0369730 | A1 | 12/2014 | Bayerle et al. | |
| 2014/0376980 | A1 | 12/2014 | McDavid et al. | |
| 2015/0063836 | A1 | 3/2015 | Wu et al. | |
| 2015/0063857 | A1 | 3/2015 | Battat et al. | |

FOREIGN PATENT DOCUMENTS

| | | | | |
|---|---|---|---|---|
| JP | 404029280 | A | | 1/1992 |
| JP | 11045025 | A | * | 2/1999 |

* cited by examiner

BACKUP BELT ASSEMBLY FOR A FUSING SYSTEM

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Disclosure

The present invention relates to an electrophotographic imaging apparatus, and more particularly to a backup belt assembly for use in a fusing system of such an apparatus.

2. Description of the Related Art

In an electrophotographic image forming apparatus, such as a printer or copier, a latent image is formed on a light sensitive drum and developed with toner. The toner image is then transferred onto media, such as a sheet of paper, and is subsequently passed through a fuser assembly where heat and pressure are applied to melt and adhere the unfused toner to the surface of the media. There is an assortment of devices available to apply heat and pressure to the media sheet, such as radiant fusing, convection fusing, and contact fusing. Contact fusing is the typical approach of choice for a variety of reasons including cost, speed and reliability. Contact fusing systems themselves can be implemented in a variety of ways. For example, a hot roller fusing system includes a fuser roller and a backup roller in contact with one another so as to form a nip therebetween, which is under a specified pressure. A heat source is associated with the fuser roll, backup roll, or both rollers in order to raise the temperature of the rollers to a temperature capable of adhering unfixed toner to a medium. As the medium passes through the nip, the toner is adhered to the medium via the pressure between the rollers and the heat resident in the fusing region (nip). As speed requirements demanded from fusing systems are increased, the size of the fuser and backup rollers must be increased, and the capability of the heat source must be expanded to sustain a sufficient level of energy necessary to adhere the toner to the medium in compensation for the shorter amount of time that the medium is in the nip. This in turn can lead to higher cost, and large rollers.

As an alternative to the above described hot roller fusing system, a backup belt fusing system can be used. In such backup belt fusing systems, there is typically a stationary pressure pad against which the fuser roller is pressed through a belt to form a fusing nip therebetween. A heat source is then applied to the fuser roll, belt or both to generate sufficient heat within the system to adhere unfixed toner to a medium as the medium is passed between the fuser roller and the belt. Generally, a backup belt fusing system has a quicker warm up time with respect to a comparable fusing system employing a backup roller. Also, a backup belt fusing system allows reduction in the size of the fusing system necessary to attain the adhesion of toner to media, which in turn reduces the cost of the fusing system. However, although generally successful in achieving a larger nip width, the typical backup belt fusing system has drawbacks. The backup belt is vulnerable to wear due to its inner surface repeatedly slidingly contacting the pressure pad. The contacting surfaces of the backup belt and the pressure pad abrade each other which, after a long period of operation, may potentially result in belt failure. In addition to wear issues, the torque required to drive the fuser roller is substantially increased, due to the contact with the pressure pad, which can damage the gear train driving the fixing members due to increased stress during rotation.

Accordingly, alternative designs of fuser systems including backup belt fusing systems are desired.

SUMMARY

Example embodiments overcome shortcomings of existing fuser systems and satisfy a need for a fuser system that enables relatively fast process speeds, yields acceptable print quality, and has a relatively long life. According to an example embodiment, there is shown a fuser assembly including a heating element, a fuser roller receiving heat from the heating element, and a backup belt assembly. The backup belt assembly includes an endless belt; a pair of nip forming rollers positioned internally of the endless belt for supporting movement of the endless belt in an endless path, the pair of nip forming rollers contacting an inner surface of the endless belt and positioned relative to the fuser roller to provide a pressing force to a section of an outer surface of the fuser roller adjacent the endless belt so as to form an elongated fusing nip along the section. A first roller of the pair of nip forming rollers engages the fuser roller via the endless belt at an entrance of the elongated fusing nip and a second roller of the pair of nip forming rollers engages the fuser roller via the endless belt at an exit of the elongated fusing nip.

The backup belt assembly further includes at least one stationary supporting roller positioned internally of the endless belt and contacting the inner surface thereof. The at least one supporting roller may be positioned proximate to the entrance of the elongated fusing nip to provide for a favorable nip entry geometry.

In another example embodiment, the fuser assembly includes a padless backup belt assembly having an endless belt and at least two nip forming rollers contacting an inner surface of the endless belt and positioned relative to the fuser roller to provide pressure to a section of an outer surface of the fuser roller adjacent the endless belt so as to form an elongated fusing nip along the section. A first roller of the at least two nip forming rollers provides a first amount of pressure to the fuser roller at an entrance of the elongated fusing nip and a second roller of the at least two nip forming rollers provides a second amount of pressure to the fuser roller at an exit of the elongated fusing nip. In an example embodiment, the first amount of pressure is less than the second amount of pressure.

BRIEF DESCRIPTION OF THE DRAWINGS

The above-mentioned and other features and advantages of the disclosed example embodiments, and the manner of attaining them, will become more apparent and will be better understood by reference to the following description of the disclosed example embodiments in conjunction with the accompanying drawings, wherein.

DETAILED DESCRIPTION

Figure 1:
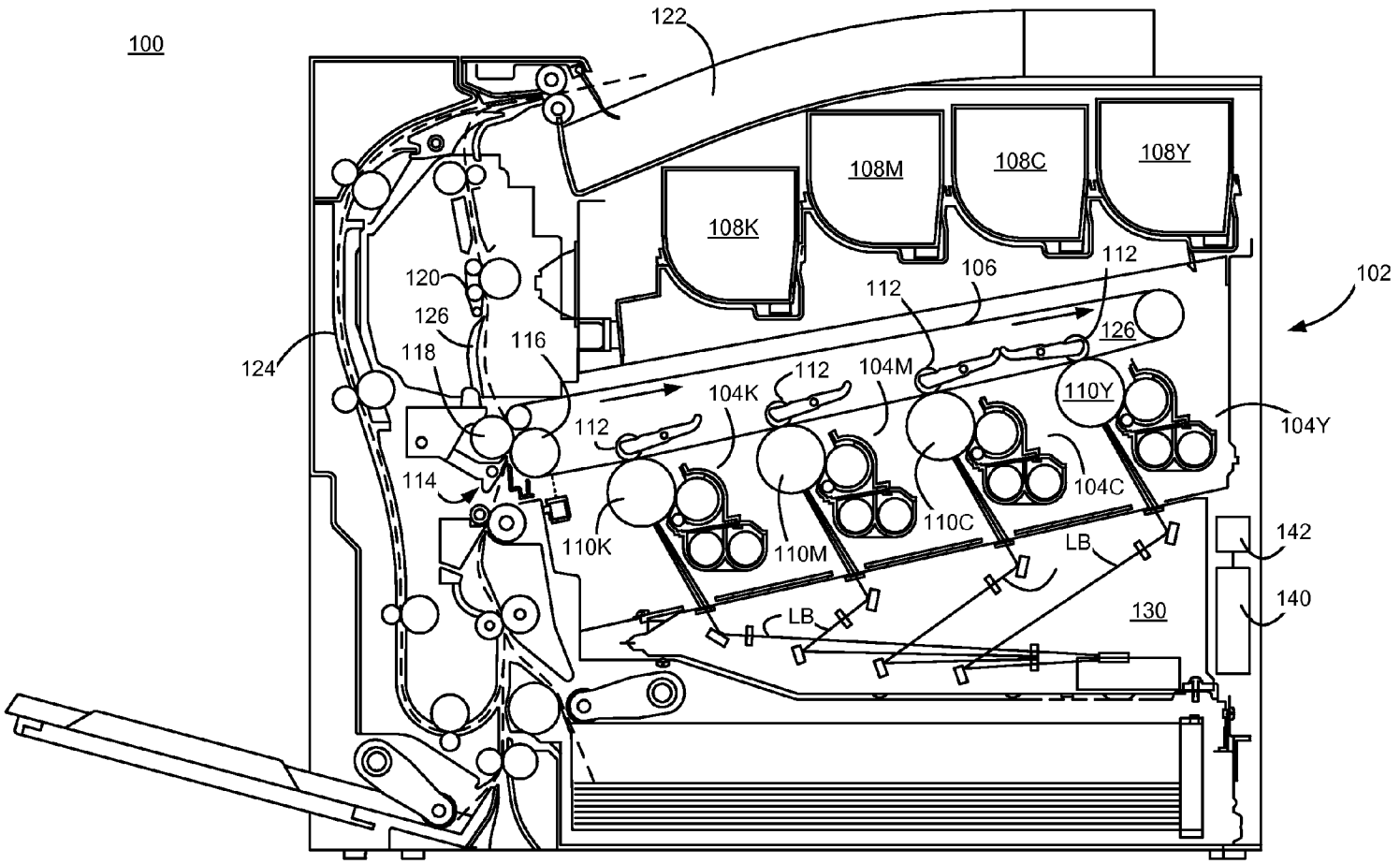
FIG. 1 is a side view of a color electrophotographic printer with a backup belt fuser assembly according to example embodiments of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

FIG. 1 illustrates a color image forming device 100 according to an example embodiment. Image forming device 100 includes a first transfer area 102 having four developer units 104 that substantially extend from one end of image forming device 100 to an opposed end thereof. Developer units 104 are disposed along an intermediate transfer member (ITM) belt 106. Each developer unit 104 holds a different color toner. Developer units 104 may be aligned in order relative to the direction of ITM belt 106 indicated by the arrows in FIG. 1, with the yellow developer unit 104Y being the most upstream, followed by cyan developer unit 104C, magenta developer unit 104M, and black developer unit 104K being the most downstream along ITM belt 106.

Each developer unit 104 is operably connected to a toner reservoir 108 for receiving toner for use in an imaging operation. Each toner reservoir 108 is controlled to supply toner as needed to its corresponding developer unit 104. Each developer unit 104 is associated with a photoconductive member 110 that receives toner therefrom during toner development to form a toned image thereon. Each photoconductive member 110 is paired with a transfer member 112 for use in transferring toner to ITM belt 106 at first transfer area 102.

During color image formation, the surface of each photoconductive member 110 is charged to a specified voltage, such as −800 volts, for example. At least one laser beam LB from a printhead 130 is directed to the surface of each photoconductive member 110 and discharges those areas it contacts to form a latent image thereon. In one example embodiment, areas on the photoconductive member 110 illuminated by the laser beam LB are discharged to approximately −100 volts. Each of developer units 104 then transfers toner to its corresponding photoconductive member 110 to form a toner image thereon. The toner is attracted to the areas of the surface of photoconductive member 110 that are discharged by the laser beam LB from the printhead 130.

ITM belt 106 is disposed adjacent to each developer unit 104. In this example embodiment, ITM belt 106 is formed as an endless belt disposed about a drive roller and other rollers. During image forming operations, ITM belt 106 moves past photoconductive members 110 in a clockwise direction as viewed in FIG. 1. One or more of photoconductive members 110 applies its toner image in its respective color to ITM belt 106. For mono-color images, a toner image is applied from a single photoconductive member 110K. For multi-color images, toner images are applied from two or more photoconductive members 110. In one example embodiment, a positive voltage field formed in part by transfer member 112 attracts the toner image from the associated photoconductive member 110 to the surface of moving ITM belt 106.

ITM belt 106 rotates and collects the one or more toner images from the one or more developer units 104 and then conveys the one or more toner images to a media sheet at a second transfer area 114. Second transfer area 114 includes a second transfer nip formed between at least one backup roller 116 and a second transfer roller 118.

Fuser assembly 120 is disposed downstream of second transfer area 114 and receives media sheets with the unfused toner images superposed thereon. In general terms, fuser assembly 120 applies heat and pressure to the media sheets in order to fuse toner thereto. After leaving fuser assembly 120, a media sheet is either deposited into output media area 122 or enters duplex media path 124 for transport to second transfer area 114 for imaging on a second surface of the media sheet.

Figure 2:
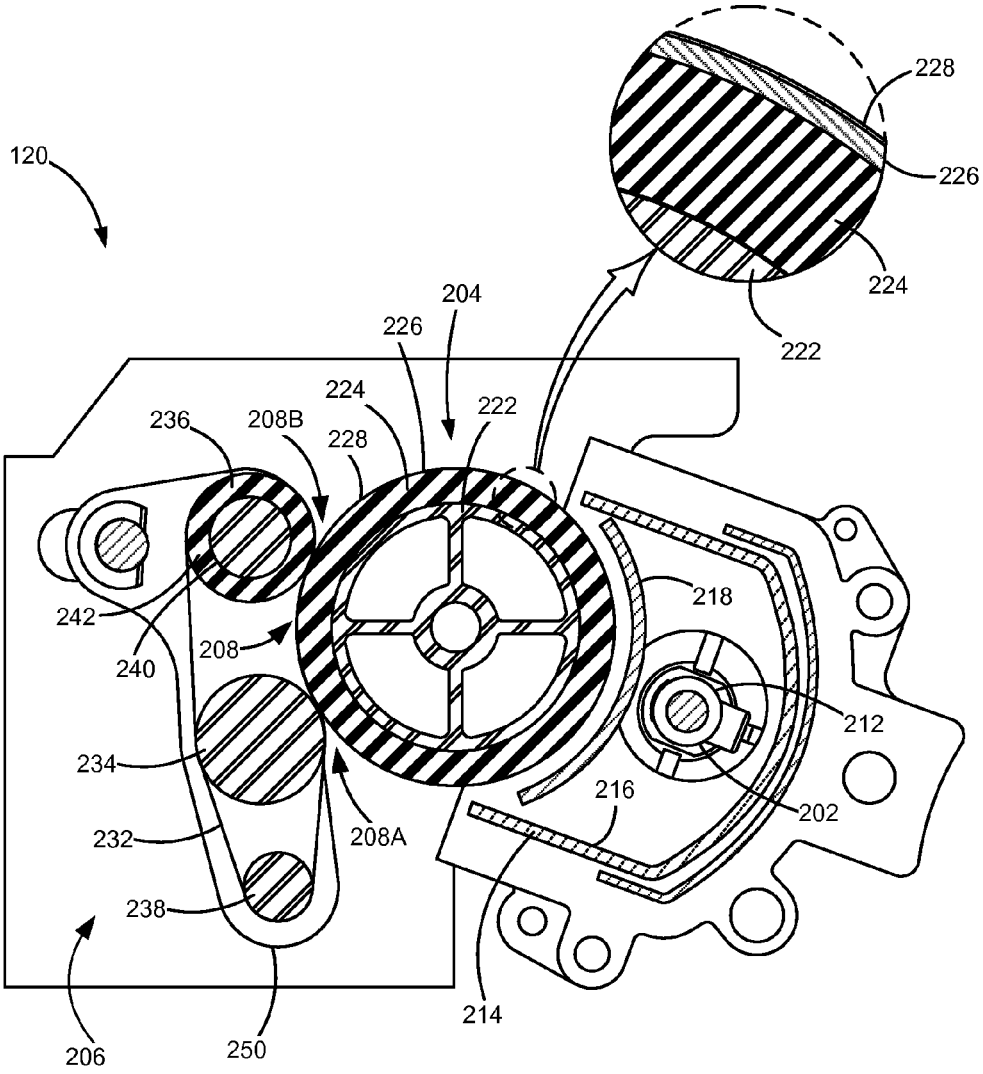
FIG. 2 is a side cross sectional view of an example embodiment of the backup belt fuser assembly depicted in FIG. 1 according to an example embodiment.

Referring now to FIG. 2, fuser assembly 120 includes a heating assembly 202, fuser roller 204, and a backup belt assembly 206 cooperating with the fuser roller 204 to define a fusing nip region 208 through which a media sheet passes so as to fuse toner material to the media sheet. In one example embodiment, fuser roller 204 is driven by a motor (not shown). A media entry guide 126 (FIG. 1) is provided just upstream of the fuser assembly 120 for guiding the media sheet into the fusing nip region 208.

As shown, heating assembly 202 is positioned externally of fuser roller 204 but with sufficient proximity thereto so as to heat the fuser roller 204 to the required temperature for fusing toner to the media sheet. Heating assembly 202 may include any suitable heat generating means, such as radiant, convection, microwave, and induction heat sources. In one example embodiment, heating assembly 202 is in the form of a lamp 212 surrounded by a reflector 214 having a highly reflective inner surface 216 for directing the heat energy from the lamp 212 towards the fuser roller 204. A shield 218 may be disposed between the lamp 212 and the fuser roller 204 to prevent media from coming into direct contact with the lamp 212 and to reduce the introduction of contaminants such as paper dust and other foreign particles onto lamp 212 and the reflector surface 216. Shield 218 may be formed from quartz and as such is substantially transparent to the radiant heat. Lamp 212 may be any of a number of different lamps and types of lamps for generating heat, and in an example embodiment may be a quartz halogen lamp. In the example embodiment shown in FIG. 2, reflector 214 has a substantially U-shape to reflect and concentrate the radiant energy from lamp 212. It is understood, however, that reflector 214 may have other suitable shapes. Inner surface 216 of reflector 214 may be constructed from polished aluminum or other suitable materials.

The fuser roller 204 includes a hollow metal core member 222, a heat insulation elastic layer 224 surrounding core member 222, a heat transport layer 226 surrounding the heat insulation elastic layer 224, and a top release layer 228 surrounding the heat transport layer 226. The core member 222 provides the rigidity of the fuser roller and may be constructed of aluminum or steel. Heat insulation elastic layer 224 may be constructed of micro balloon foam rubber, minicell foam or similar material with a Poisson's ratio of about 0.36 to about 0.4. The heat insulation elastic layer 224 insulates the fuser roller 204 to keep heat on the outer surface thereof and also provides elasticity to the fuser roller 204 so as to form a favorable shape of the fusing nip region 208 for good release and good print quality. The heat transport layer 226 may be made of a relatively high thermal conductivity rubber in order to effectively receive heat from the heating element 202 and release heat. The top release layer 228 may be a fluorinated polymer release layer, such as a perfluoroalkoxy copolymer (PFA) or a polytetrafluoroethylene (PTFE) layer, which helps the toner on the media sheet to separate from the surface of fuser roller 204 after it passes through the fusing nip region 208.

The backup belt assembly 206 includes an endless belt 232, a pair of nip forming rollers 234, 236 positioned internally of the endless belt 232 for supporting movement thereof and positioned relative to the fuser roller 204 to provide a pressing force to a section of an outer surface of the fuser roller 204 to form the fusing nip region 208 therewith, and a supporting roller 238 positioned internally of the endless belt 232 and proximate to an entrance 208A of the fusing nip region 208 to provide for a favorable nip entry geometry. In one example embodiment wherein the fuser roller 204 is a driving roller, the nip forming rollers 234, 236 are not directly driven but rotate by virtue of their engagement with the fuser roller 204.

The endless belt 232 may comprise a polyimide member having a thickness between about 50 microns and about 100 microns. The endless belt 232 may further include an outer release coating or layer, such as a spray coated PFA layer having a thickness between about 5 microns and about 30 microns, or a dip-coated PTFE/PFA blend layer having a thickness between about 5 microns and about 30 microns. The release coating or layer is provided on an outer surface of the polyimide member so as to contact the media sheet passing between the fuser roller 204 and the backup belt assembly 206.

Nip forming rollers 234 and 236 engage the fuser roller 204 via the endless belt 232 at entrance 208A and at an exit 208B of the fusing nip region 208, respectively. Nip forming roller 234 may be constructed of metal, such as aluminum or steel, for conducting excess heat from the fuser roller 204 and transferring the heat along the axis of roller 234. In one example embodiment, nip forming roller 234 may be a heat pipe or a metal roll having a heat pipe disposed therein as disclosed in U.S. patent application 61/834,869, filed Jun. 13, 2013, and entitled, "Heat Transfer System for a Fuser Assembly," the content of which is hereby incorporated by reference herein in its entirety. In this way, when fusing narrow media, nip forming roll 234 transfers heat axially so as to prevent from overheating a portion of fuser roll 204 and/or endless belt 232 which do not contact the narrow media. The outer diameter of the nip forming roller 234 may be about 10 mm to about 20 mm. Nip forming roller 236 includes a metal shaft 240, such as steel, having a diameter of from about 9 mm to about 20 mm. The shaft 240 may be surrounded with a thermally non-conductive elastomeric layer 242, such as a silicone rubber. The elastomeric layer 242 may have a thickness of about 0.5 to about 3 mm and the outer diameter of the nip forming roller 236 may be about 10 mm to about 25 mm. In one example contemplated embodiment, the nip forming rollers 234 and 236 may have substantially the same outer diameter.

In one example embodiment, since it has an elastomeric layer 242, nip forming roller 236 may cause the deflection of some component or itself be deflected in the area where the nip forming roller 236 forces contact of the endless belt 232 with the fuser roller 204. The actual deflection (if deflection occurs) of the fuser roller 204 and/or the nip forming roller 236 will vary depending upon the compliance of the fuser roller 204, the compliance of the nip forming roller 236, and the pressure between the fusing roller 204 and the backup belt assembly 206. Moreover, while only two nip forming rollers 234, 236 are shown, it may be possible to use three or more nip forming rollers as part of backup belt assembly 206.

The supporting roller 238 may include a metal shaft, such as steel or aluminum having a diameter between about 7 mm and about 20 mm. In the example embodiment, the metal shaft of the supporting roller 238 is not covered with an elastomeric layer. In this embodiment, when fusing narrow media, metal supporting roller 238 may transfer heat axially so as to prevent a portion of fuser roll 204 and/or endless belt 232 which do not contact the narrow media from overheating. In another example embodiment, supporting roller 238 may take the form of a metal roll containing a heat pipe therein for conducting excess heat and transferring the heat along the axis of supporting roller 238. While it is shown that supporting roller 238 is positioned proximate to the entrance 208A of the fusing nip region 208, supporting roller 238 may be positioned anywhere within endless belt 232 to provide for a favorable nip entry geometry.

Figure 3:
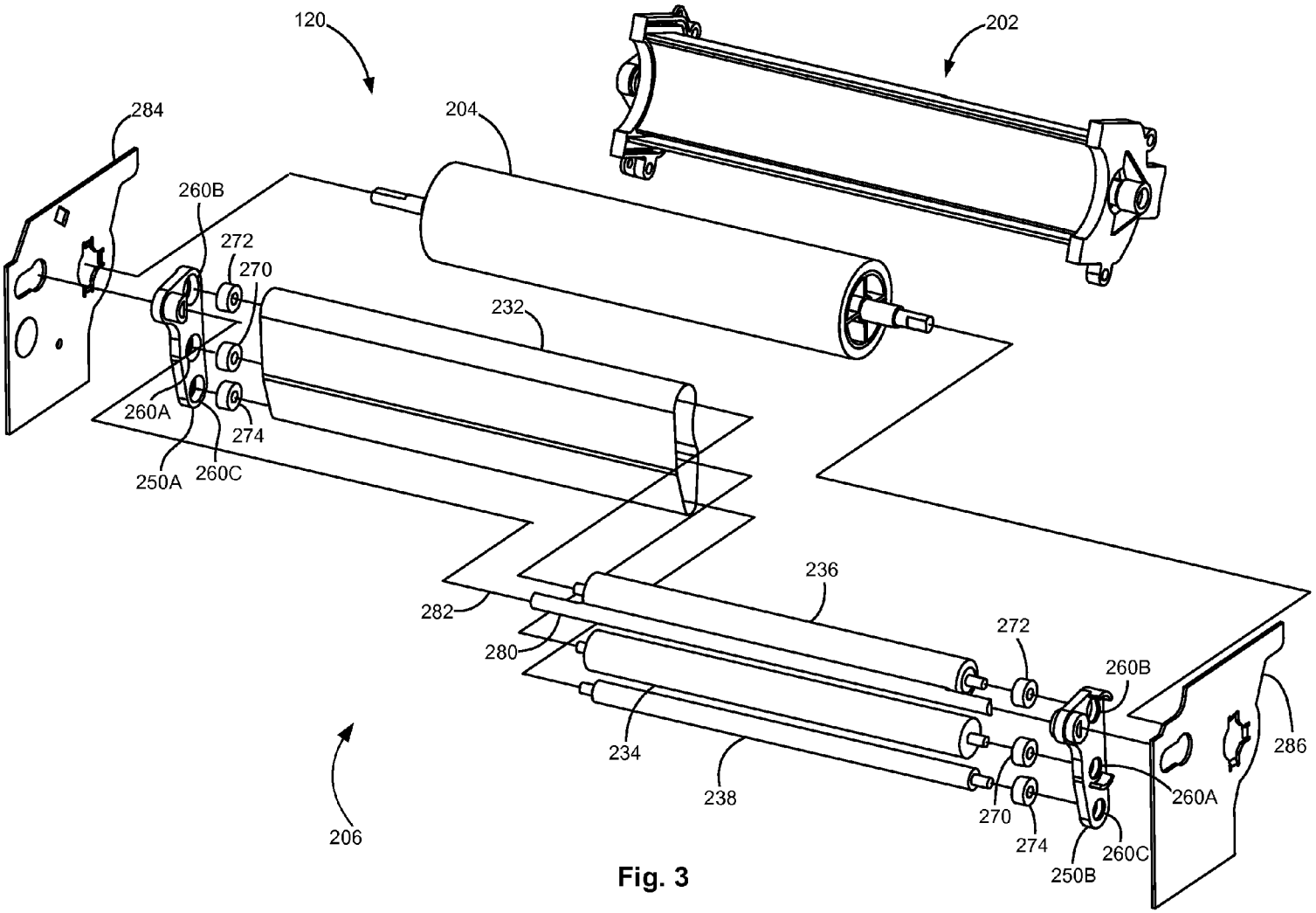
FIG. 3 is an exploded perspective view of the backup belt fuser assembly depicted in FIG. 2 according to an example embodiment.
Figure 4:
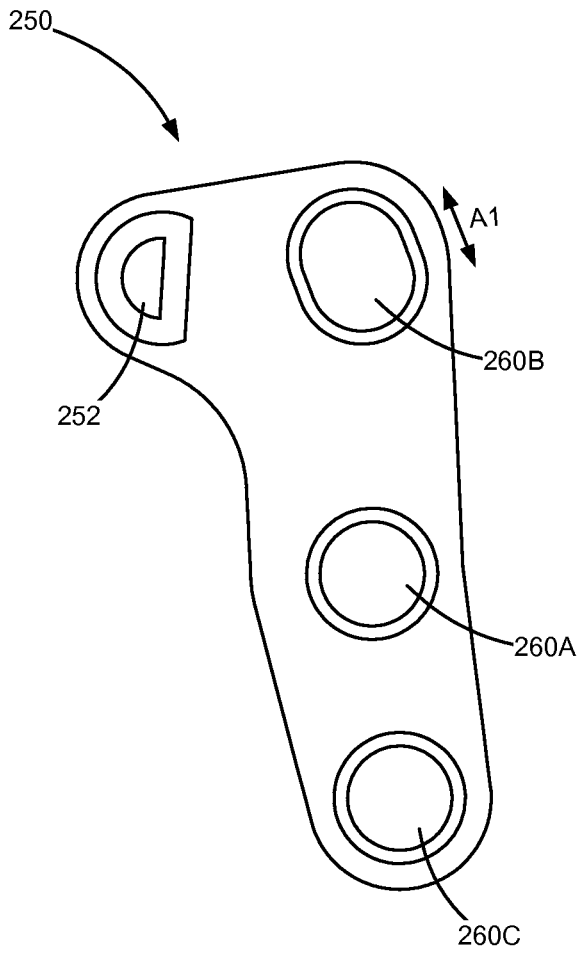
FIG. 4 is a side view a bearing plate depicted in FIG. 2.

With reference to FIGS. 3 and 4, each nip forming roller 234, 236 and supporting roller 238 is rotatably supported on both ends by a pair of opposed bearing plates 250A, 250B. Each bearing plate 250A, 250B includes three holes 260A, 260B, 260C for receiving three bearings 270, 272, 274, respectively. Each pair of bearings 270, 272 and 274 receives the shaft ends of nip former rollers 234, 236 and supporting roller 238, respectively. At least one of the three holes 260A, 260B, 260C may be in the form of a slot to allow movement of corresponding shaft ends of one of the rollers 234, 236 and 238 for nip pressure and belt tension adjustment.

Fuser assembly 120 further includes a shaft 280 and sidewalls 284, 286. Shaft 280 supports the pair of opposed bearing plates 250A, 250B. In particular, the pair of opposed bearing plates 250A, 250B are coupled to opposite ends of shaft 280. Ends of the shaft 280 may have a substantially D-shaped cross-section for engaging corresponding D-shaped apertures 252 on the pair of opposed bearing plates 250A, 250B such that shaft 280 is inhibited from rotational movement with respect to the bearing plates 250A, 250B. Shaft 280 is pivotably supported between opposed sidewalls 284, 286 of fuser assembly 120. Specifically, each sidewall 284, 286 includes a slot 290 through which a bearing plate 250A, 250B is disposed. Slots 290 are sized to allow for substantially lateral and/or rotational movement of bearing plates 250, and therefore the entire backup belt assembly 206, relative to fuser roller 204. At least one end of shaft 280 may be coupled to a positioning mechanism (not shown) and/or may be driven by a suitable driving device (not shown) to cause the backup belt assembly 206 to translate and/or rotate relative to fuser roller 204. For instance, the backup belt assembly 206 may be translated along slot 290 between a first position in which the backup belt assembly 206 is urged against the fuser roller 204, and a second position in which the backup belt assembly 206 is released from engagement with the fuser roller 204. In addition, shaft 280 may be rotated so as to change the orientation of the backup belt assembly 206 relative to the fuser roller 204.

Figure 5:
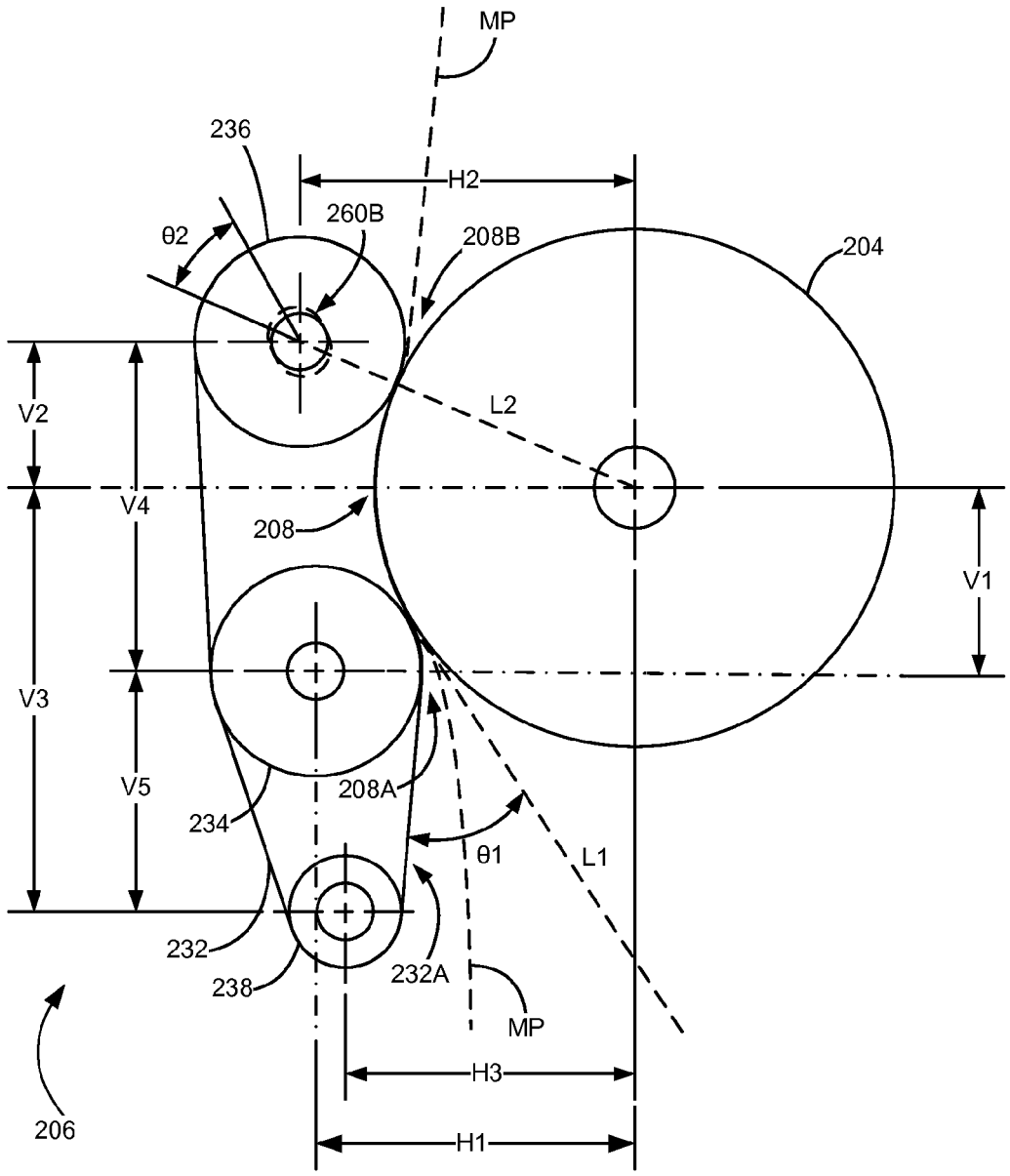
FIG. 5 is a detailed side view of the backup belt fuser assembly in FIG. 2 according to an example embodiment.

With reference to FIG. 5, in one example embodiment, the vertical (as viewed from FIG. 5) distance V1 between the nip forming roller 234 axis and the fuser roller 204 axis is about 13 mm; the vertical distance V2 between the nip forming roller 236 axis and the fuser roller 204 axis is about 10 mm to about 11 mm; and the vertical distance V3 between the supporting roller 238 axis and the fuser roller 204 axis is about 30 mm. Further, the vertical distance V4 between the nip forming roller 234 axis and the nip forming roller 236 axis is about 23 mm to about 24 mm; and the vertical distance V5 between the nip forming roller 234 axis and the supporting roller 238 axis is about 17 mm. The horizontal distance H1 between the nip forming roller 234 axis and the fuser roller 204 axis is about 22 mm; the horizontal distance H2 between the nip forming roller 236 axis and the fuser roller 204 axis is about 23 mm to about 24 mm; and the horizontal distance H3 between the supporting roller 238 axis and the fuser roller 204 axis is about 20 mm.

As mentioned above, the fuser roller 204 has an elastic layer 224 which may cause the deflection of a nip forming roller 234, 236 and/or itself in the areas where the nip forming rollers 234, 236 force contact of the endless belt 232 with the fuser roller 204. The deflection of the fuser roller 204 can affect the media speed which results in overdrive. The term "overdrive" refers to the difference between the media sheet speed and the free surface speed of a roll, such as the fuser roller 204. As can be seen, overdrive may impact fusing, wrinkling and image defects of fuser assembly 120. Accordingly, the fuser assembly 120 is designed such that the paper speed differential or overdrive is small in each of the areas where the nip forming rollers 234, 236 force contact of the endless belt 232 with the fuser roller 204. In addition, the polarity or sign of the amount of overdrive with respect to nip forming roller 234 is the opposite of the polarity or sign of the amount of overdrive with respect to nip forming roller 236. Further, the average overdrive in the fusing nip region 208 is relatively close to zero.

In one example embodiment, the nip forming roller 234, which urges the endless belt 232 into contact against the fuser roller 204 at the entrance 208A of the fusing nip region 208, is arranged to cause the fuser roller 204 to be deflected by about 0.2 mm to about 0.3 mm. Further, nip forming roller 236, which urges the endless belt 232 into contact against the fuser roller 204 at the exit 208B of the fusing nip region 208, is arranged to cause the fuser roller 204 to be deflected by about 0.7 mm to about 0.8 mm. This arrangement allows for reduced net overdrive which results in improved print quality. In particular, this arrangement allows for about −0.1 to about −0.2 percent overdrive at the entrance 208A of the fusing nip region 208 and about +0.3 to about +0.4 percent overdrive at the exit 208B of the fusing nip region 208, for an average overdrive of only about +0.1 to about +0.2 percent.

The nip forming rollers 234, 236 of the backup belt assembly 206 allow the fusing nip region 208 between the fusing roller 204 and the backup belt assembly 206 to be increased relative to other fuser architectures. The increased fusing nip region 208 allows for faster printer process speeds since the distance during which the media sheet is within the fusing nip region 208 offsets the increase in processing speed of the media sheet. In one example embodiment, the fusing nip region 108 has a length of about 13 mm to about 20 mm.

In the illustrated example embodiment shown in FIG. 5, a section 232A of the endless belt 232 defined between the entrance 208A of the fusing nip region 208 and an outer surface of the supporting roller 238 forms an angle θ1 that is between about 35 to about 45 degrees with a line L1 that is tangent to the fuser roller 204 at the entrance 208A of the fusing nip region 208. Section 232A of endless belt 232 disposed at angle θ1 provides a suitable guide for the media sheet to contact before entering the fusing nip region 208.

The position of one of the nip forming rollers 234, 236 is adjustable for adjusting at least one operating characteristic of the fuser assembly 120, e.g. the length of fusing nip region 208, the fuser nip pressure, the tension of endless belt 232, etc. In one example embodiment, nip forming roller 236 is moveable within slot 260B of bearing plates 250A, 250B in the direction indicated by Arrow A1 of FIG. 4. As shown in FIG. 5, slot 260B is positioned at an angle θ2 between about 0 and about 90 degrees, and particularly between about 40 and about 50 degrees with respect to a line L2 connecting the rotational axis of the fuser roller 204 to the rotational axis of the nip forming roller 236.

Figure 7:
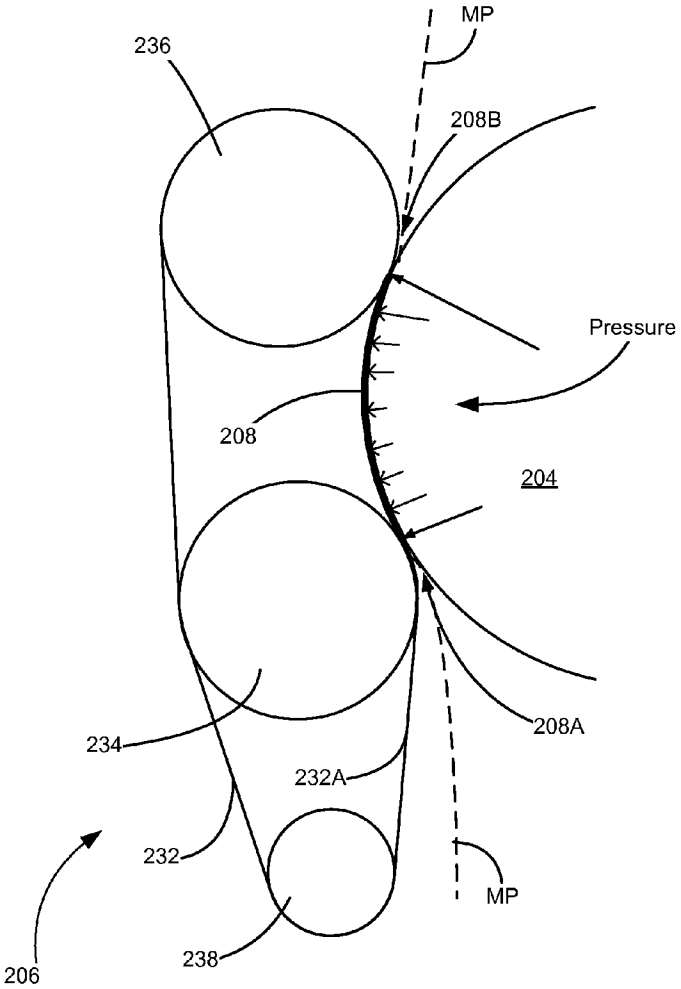
FIG. 7 is a side view of the fuser and backup belt assembly generally depicting the load distribution at the fusing nip according to an example embodiment.
Figure 6:
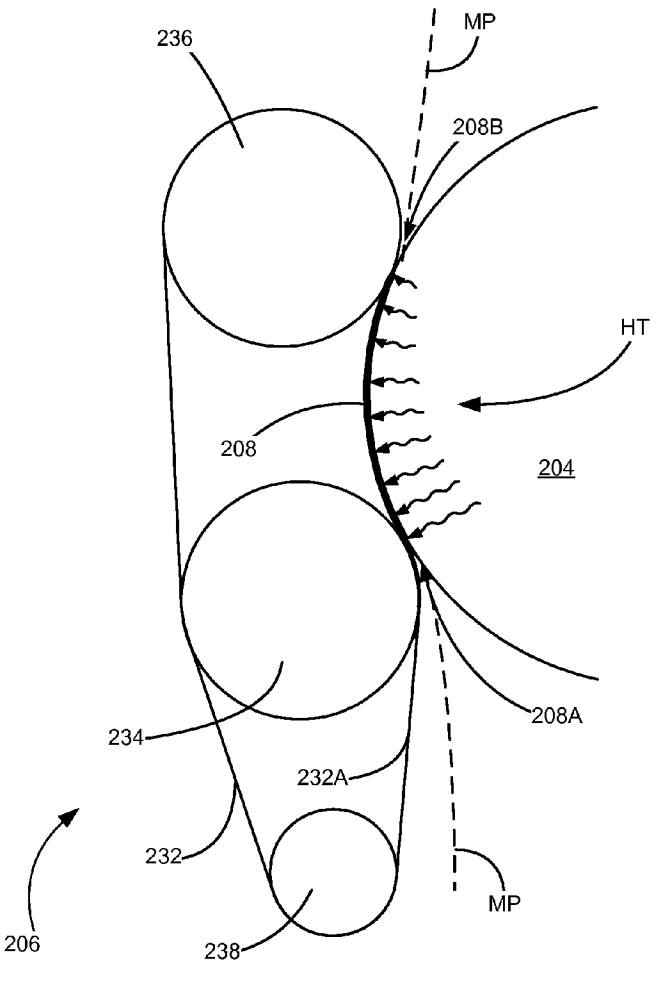
FIG. 6 is a side view of the backup belt fuser assembly generally depicting heat transfer distribution at the fusing nip according to an example embodiment.

FIGS. 6 and 7 illustrate approximate temperature and pressure profiles of fuser roller 204 at the fusing nip region 208 according to an example embodiment. FIG. 6 shows that the temperature profile of fuser roller 204 through the fusing nip region 208 has a gradually decreasing trend from entrance 208A to exit 208B of fuser nip region 208. As the media sheet enters the entrance 208A of the fusing nip region 208, heat transfer HT occurs between the fuser roller 204 and the media sheet wherein a portion of the heat from the fuser roller 204 is absorbed by the media sheet while it is in the fusing nip region 208. Accordingly, the temperature of fuser roller 204 at the exit 208B is lower compared to the higher temperature at the entrance 208A of the fusing nip region 208.

FIG. 7 depicts an approximate nip pressure profile through the fusing nip region 208. In one example embodiment, the ratio of the load at the entrance 208A to the load at the exit 208B of the fusing nip region 208 is between about 1:5 and about 1:3, such as about 1:4. Further, the increased pressure and the shape of the fusing nip region 208 at the exit 208B thereof provide a shearing force that facilitates the sheet of media to release easily from the fuser assembly 120. The increasing pressure profile is due at least in part to the difference in compliance of nip forming roller 234, 236, the amount of deflection each nip forming roller forms against the fuser roller 204, and the spacing therebetween. As such, the size of the fusing nip region 208 and the amount of pressure applied along the length of the fusing nip region 208 can be controlled by the selection of the size, positioning and compliance of each of the nip forming rollers 234, 236 and the fuser roller 204.

The fuser assembly 120 is illustrated in FIG. 2 as having heating assembly 202 positioned externally of fuser roller 204. In an alternative embodiment, the heating assembly is disposed internally of fuser roller 204 and heats the outer surface of fuser roller 204 from within. The heating assembly 202 may include a lamp like lamp 212 or other heat source. In this alternative embodiment, the fuser roller may include other layers for transporting internally generated heat to the outer surface thereof. For example, the fuser roller may be similar in structure to the fuser rollers described in U.S. Pat. Nos. 7,020,424, 7,272,353 and 7,386,264, which are assigned to the assignee of the present application, the contents of which are hereby incorporated by reference herein in their entirety.

Further, it is understood that more than two nip forming rollers may be used to form fusing nip region 208. For example, at least a third nip forming roller may be disposed between nip forming rollers 234 and 236 in FIG. 2.

The foregoing description of methods and example embodiments of the disclosure have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A fuser assembly for an electrophotographic imaging device, comprising:

a heating element;

a fuser roller receiving heat from the heating element; and a backup belt assembly coupled to the fuser roller, comprising an endless belt;

a pair of nip forming rollers positioned internally of the endless belt for supporting movement of the endless belt in an endless path, the pair of nip forming rollers contacting an inner surface of the endless belt and positioned relative to the fuser roller to provide a pressing force to a section of an outer surface of the fuser roller adjacent the endless belt so as to form an elongated fusing nip along the section, wherein a first roller of the pair of nip forming rollers engages the fuser roller via the endless belt at an entrance of the elongated fusing nip and a second roller of the pair of nip forming rollers engages the fuser roller via the endless belt at an exit of the elongated fusing nip; and at least one supporting roller positioned internally of the endless belt and contacting the inner surface thereof, the at least one supporting roller supporting movement of the endless belt, wherein the at least one supporting roller is positioned proximate to the entrance of the elongated fusing nip; and a section of the endless belt defined between the entrance of the elongated fusing nip and an outer surface of the at least one supporting roller forms an acute angle with a line tangent to the fuser roller at the entrance of the elongated fusing nip.

2. The fuser assembly of claim 1, wherein the pressing force to the section of the endless belt against the outer surface of the fuser roller is less at the entrance of the elongated fusing nip than the pressing force at the exit thereof.

3. The fuser assembly of claim 2, wherein a ratio of the pressing force at the entrance of the elongated fusing nip to the pressing force at the exit thereof is about 1:4.

4. The fuser assembly of claim 1, wherein at least one of the first roller and the second roller of the pair of nip forming rollers is made movable so as to adjust the belt tension of the backup belt assembly.

5. The fuser assembly of claim 1, further comprising a frame having a pair of opposed slots rotatably supporting ends of at least one of the pair of nip forming rollers, the slots positioned at an acute angle with respect to a line connecting an axis of the fuser roller to an axis of the at least one of the pair of nip forming rollers, wherein ends of the least one of the pair of nip forming rollers are made movable within the slots so as to adjust the belt tension of the backup belt assembly.

6. The fuser assembly of claim 1, wherein at least one of the pair of nip forming rollers comprises a heat pipe.

7. The fuser assembly of claim 1, wherein the elongated fusing nip has a length of about 13 mm to about 20 mm.

8. A fuser assembly for an image forming device for fusing an unfixed toner image to a media sheet, comprising:

a heating element;

a fuser roller receiving heat from the heating element; and a padless backup belt assembly including:

an endless belt; and at least two nip forming rollers contacting an inner surface of the endless belt and positioned relative to the fuser roller to provide pressure to a section of an outer surface of the fuser roller adjacent the endless belt so as to form an elongated fusing nip along the section, wherein a first roller of the at least two nip forming rollers provides a first amount of pressure to the fuser roller at an entrance of the elongated fusing nip and a second roller of the at least two nip forming rollers provides a second amount of pressure to the fuser roller at an exit of the elongated fusing nip;

wherein at least one of the first roller and the second roller of the at least two nip forming rollers is made movable so as to adjust the belt tension of the backup belt assembly.

9. The fuser assembly of claim 8, wherein the padless backup belt assembly further comprises at least one supporting roller positioned internally of the endless belt and contacting the inner surface thereof for supporting movement of the endless belt.

10. The fuser assembly of claim 9, wherein the at least one supporting roller is positioned proximate to the entrance of the elongated fusing nip.

11. The fuser assembly of claim 9, wherein a section of the endless belt defined between the entrance of the elongated fusing nip and an outer surface of the at least one supporting roller forms an acute angle with a line tangent to the fuser roller at the entrance of the elongated fusing nip.

12. The fuser assembly of claim 8, wherein a ratio of the load distribution at the entrance of the elongated fusing nip to the load distribution at the exit thereof is about 1:4.

13. The fuser assembly of claim 8, further comprising a frame having a pair of opposed slots rotatably supporting ends of at least one of the at least two nip forming rollers, the slots positioned at an acute angle with respect to a line connecting an axis of the fuser roller to an axis of the at least one of the at least two nip forming rollers, wherein ends of the least one of the at least two nip forming rollers are made movable within the slots so as to adjust the belt tension of the backup belt assembly.

14. The fuser assembly of claim 8, wherein at least one of the at least two nip forming rollers is made of thermally conductive material.

15. The fuser assembly of claim 8, wherein the elongated fusing nip has a length of about 13 mm to about 20 mm.

16. The fuser assembly of claim 8, wherein the first amount of pressure is less than the second amount of pressure.

17. The fuser assembly of claim 8, wherein the heating element is positioned external to the fuser roller and disposed in proximity thereto.

18. The fuser assembly of claim 8, wherein the at least one of the at least two nip forming rollers comprises a heat pipe.

19. A fuser assembly for an electrophotographic imaging device, comprising:

a heating element;

a fuser roller receiving heat from the heating element; and a backup belt assembly coupled to the fuser roller, comprising an endless belt;

a pair of nip forming rollers positioned internally of the endless belt for supporting movement of the endless belt in an endless path, the pair of nip forming rollers contacting an inner surface of the endless belt and positioned relative to the fuser roller to provide a pressing force to a section of an outer surface of the fuser roller adjacent the endless belt so as to form an elongated fusing nip along the section, wherein a first roller of the pair of nip forming rollers engages the fuser roller via the endless belt at an entrance of the elongated fusing nip and a second roller of the pair of nip forming rollers engages the fuser roller via the endless belt at an exit of the elongated fusing nip; and at least one supporting roller positioned internally of the endless belt and contacting the inner surface thereof, the at least one supporting roller supporting movement of the endless belt;

wherein at least one of the first roller and the second roller of the pair of nip forming rollers is made movable so as to adjust the belt tension of the backup belt assembly.

20. The fuser assembly of claim 19, further comprising a frame having a pair of opposed slots rotatably supporting ends of at least one of the pair of nip forming rollers, the slots positioned at an acute angle with respect to a line connecting an axis of the fuser roller to an axis of the at least one of the pair of nip forming rollers, wherein ends of the at least one of the pair of nip forming rollers are made movable within the slots so as to adjust the belt tension of the backup belt assembly.

21. A fuser assembly for an image forming device for fusing an unfixed toner image to a media sheet, comprising:

a heating element;

a fuser roller receiving heat from the heating element; and a padless backup belt assembly including:

an endless belt;

at least two nip forming rollers contacting an inner surface of the endless belt and positioned relative to the fuser roller to provide pressure to a section of an outer surface of the fuser roller adjacent the endless belt so as to form an elongated fusing nip along the section, wherein a first roller of the at least two nip forming rollers provides a first amount of pressure to the fuser roller at an entrance of the elongated fusing nip and a second roller of the at least two nip forming rollers provides a second amount of pressure to the fuser roller at an exit of the elongated fusing nip;

at least one supporting roller positioned internally of the endless belt and contacting the inner surface thereof for supporting movement of the endless belt;

wherein a section of the endless belt defined between the entrance of the elongated fusing nip and an outer surface of the at least one supporting roller forms an acute angle with a line tangent to the fuser roller at the entrance of the elongated fusing nip.

* * * * *